United States Patent [19]

Iwasaki et al.

[11] 4,378,284

[45] Mar. 29, 1983

[54] CONTINUOUS ELECTROLYTIC PROCESSING APPARATUS

[75] Inventors: Kiyotoshi Iwasaki, Kisarazu; Kito Oda, Futtsu; Yoshiaki Hashimoto, Kisarazu; Yasuhiro Seto, Kitakyushu, all of Japan

[73] Assignee: Nippon Steel Corporation, Tokyo, Japan

[21] Appl. No.: 326,654

[22] Filed: Dec. 2, 1981

[30] Foreign Application Priority Data

Dec. 3, 1980 [JP] Japan ..... 55-169637

[51] Int. Cl.[3] ..... C25D 17/00

[52] U.S. Cl. ..... 204/206

[58] Field of Search ..... 204/206, 225

[56] References Cited

U.S. PATENT DOCUMENTS

| | | | |
|---|---|---|---|
| 2,395,437 | 2/1946 | Venable | 204/206 |
| 2,399,254 | 4/1946 | Rieger et al. | 204/206 |
| 3,445,371 | 5/1969 | Johnston | 204/206 |

*Primary Examiner*—T. M. Tufariello

*Attorney, Agent, or Firm*—Cushman, Darby & Cushman

[57] ABSTRACT

In a continuous electrolytic processing apparatus for a metal strip, a variation in electrode distance is achieved by an electrode-holder positioning means 40 which comprises expansible tubes 6 elastically holding the electrode holder 7. A fluid medium is admitted into the expansible tubes 6 at an adjustable pressure or amount. The electrode distance can be adjusted to conform with the processing conditions at a value which allows very efficient processing.

12 Claims, 10 Drawing Figures

CONTINUOUS ELECTROLYTIC PROCESSING APPARATUS

The present invention relates to a continuous electrolytic processing apparatus for a metal strip.

The apparatuses for electrolytically processing and electrogalvanizing a metal strip, collectively referred to as the electrolytic processing apparatus in the present specification, are provided with an anode, which is usually an electrode which is separated from the metal strip, but are not provided with a cathode which is separated from the metal strip. Namely, the metal strip itself usually behaves as the cathode in the electrolytic processing apparatus, and the metal ions in the aqueous electrolytic solution are electrolytically reduced and depsited on the cathode. The distance between the anode and cathode, hereinafter referred to as the electrode distance, is important for efficient electrolytic reduction. Generally speaking, when the electrode distance is increased, the resistance of the electrolyte is increased, with the result that efficiency is disadvantageously decreased. It is, therefore, desirable to adjust the electrode distance to a value as little as possible. However, there are a number of restrictions which do not allow to be adjusted the electrode distance to a value which allows the most efficient electrolytic processing. Examples of these restrictions are now explained with regard to a lateral electrolytic processing apparatus, in which a metal strip is horizontally conveyed during electrolytic processing. One restriction results from the fact that the metal strip, which usually behaves cathodically but occasionally anodically, forms a catenary above an electrode which is usually an anode but is occasionally a cathode, thereby possibly resulting in a short circuit between both electrodes. Another restriction results from flattering of the metal strip being conveyed in the electrolytic processing apparatus, which also results in a short circuit. Still another restriction results from the irregular shape of the metal strip being conveyed in the electrolytic processing apparatus, which also results in a short circuit.

A conventional electrolytic processing apparatus is, usually, not provided with a mechanism for varying the electrode distance in conformity with the various variations in the conveying conditions of the metal strip and is, therefore, operated in practice with a constant and broad electrode distance. It is, however, desirable to make the electrode distance variable in conformity with the various conveying conditions of the metal strip, so that a high efficiency in supplying the metal strip or a high operating efficiency in a continuous electrolytic processing apparatus can be ensured.

It is an object of the present invention to provide a continuous electrolytic processing apparatus in which the disadvantages of the conventional apparatus are removed and in which a mechanism for varying the electrode distance is mounted so as to allow variation of the electrode distance in conformity with the various conveying conditions of the metal strip and also to ensure high efficiency in operating the apparatus.

In accordance with the object of the present invention, there is provided a continuous electrolytic processing apparatus for a metal strip, comprising:

at least one electrode disposed to define an electrode distance between the electrode and the metal strip;

an electrode holder for each of the electrodes, the position of at least one of said electrode holders being adjustable in relation to the other holder;

a means for positioning the electrode holder at an adjustable electrode distance and comprising at least one pair of expansible tubes elastically holding at least one of the electrode holders; and at least one system for supplying a fluid medium into the expansible tubes at an adjustable fluid pressure or amount.

Embodiments of the present invention are explained with reference to the drawings, wherein.

Figure 1:
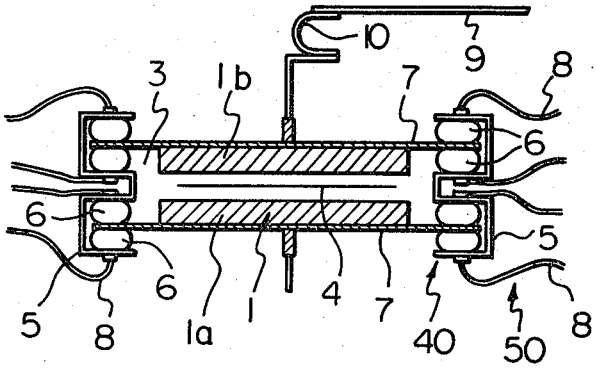
FIG. 1 is a cross-sectional view of an embodiment of the continuous electrolytic processing apparatus according to the present invention.
Figure 2:
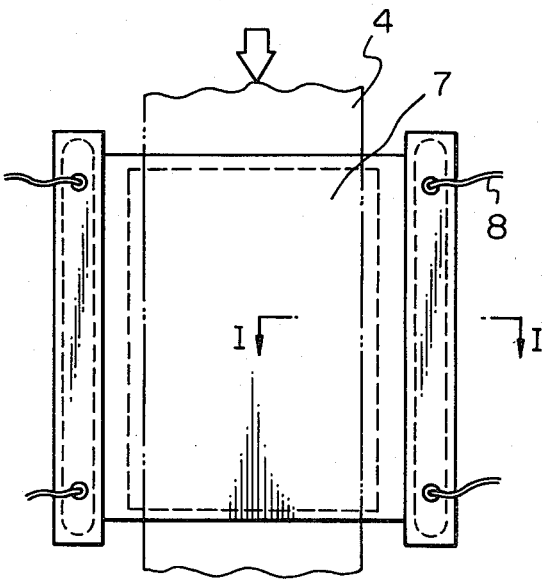
FIG. 2 is a plan view of the embodiment mentioned above.
Figure 3:
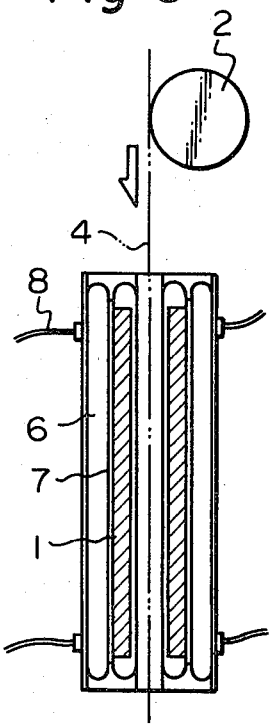
FIG. 3 is another cross-sectional view of the embodiment mentioned above.
Figure 4:
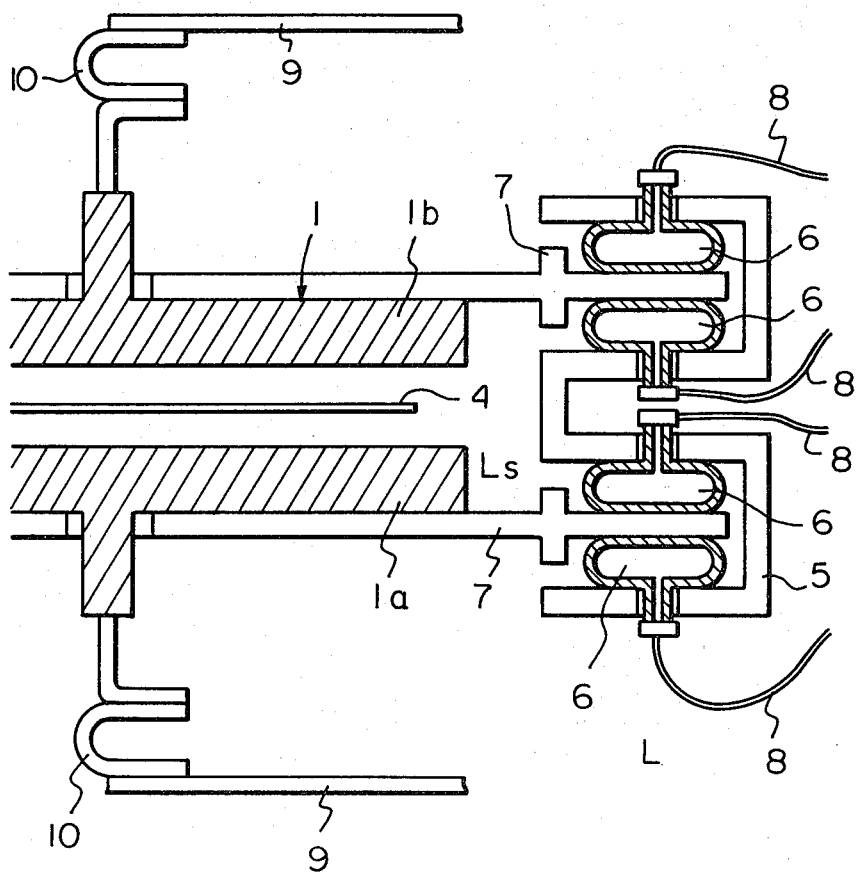
FIG. 4 is a cross-sectional view along the lines 1—1 shown in FIG. 2.

In the drawings, the embodiments of the present invention applied to a lateral continuous electrolytic processing apparatus are illustrated.

Referring to FIGS. 1 through 4, the metal strip 4 is electrically charged via a current-conducting roll 2 and is conveyed through a gap between a pair of electrodes 1. While the metal strip 4 is conveyed through the gap where the processing liquid 3, such as a plating electrolyte, is filled, the metal strip 4 is subjected to the predetermined processing, such as electrogalvanizing. Such processing of a metal strip is carried out by most of the conventional continuous electrolytic processing apparatuses.

According to the present invention, the expansible tubes 6 are mounted in the continuous electrolytic processing apparatus. These tubes are main members of the apparatus and make possible variance of the electrode distance to vary. An electrode holder 7 is provided for each electrode 1 so as to stationarily hold the electrode 1. At least one of the electrode holders 7, both electrode holders 7 in the embodiment illustrated in FIGS. 1 through 4, is displaceable toward the other electrode holder.

An electrode-holder positioning means is collectively denoted by reference 40 in FIG. 1 and comprises the four expansible tubes 6 at both ends of each electrode holder 7. The electrode-holder positioning means 40 also comprises tube-holders 5 which are secured to a stationary member not shown, for example the framework, of the continuous electrolytic processing apparatus. Each of the two electrode holders 7 is held between the four expansible tubes at both ends thereof, while the expansible tubes 6 are held, in turn, in an expansible manner by the tube-holders 5. With regard to either electrode 1, the electrode can be displaced toward the other electrode 1 and the electrode distance can be varied when two pairs of the expansible tubes 6 holding the electrode holders 7 therebetween are relatively expanded.

A fluid-medium supplying system is collectively denoted by reference numeral 50 in FIG. 1 and comprises a conduit 8 connected to each expansible tube 6. A pressure fluid is supplied from a source (not shown) to the expansible tubes 6 through the conduits 8 at an adjustable pressure or amount. Therefore, the electrode distance, namely, the distance between the upper and lower electrodes, can be adjusted by controlling the pressure or flowing amount of the fluid.

The continuous electrolytic processing apparatus further comprises a flexible current conductor 10 electrically connected to each of the electrodes 1, thereby allowing the electrode holders 7 and electrodes 1 to be displaced in conformity with the relative expansion mentioned above. The current is conducted through the bus bar 9 and flexible current conductor 10 to each of the electrodes 1.

The electrode holder positioning means 40 may be provided for either or both of the electrodes 1 which define the gap therebetween for conveying the metal strip 4. In addition, when a pair of the electrode-holding means 40 is used for varying the electrode distance, either means may be actuated independently of the other.

Figure 5:
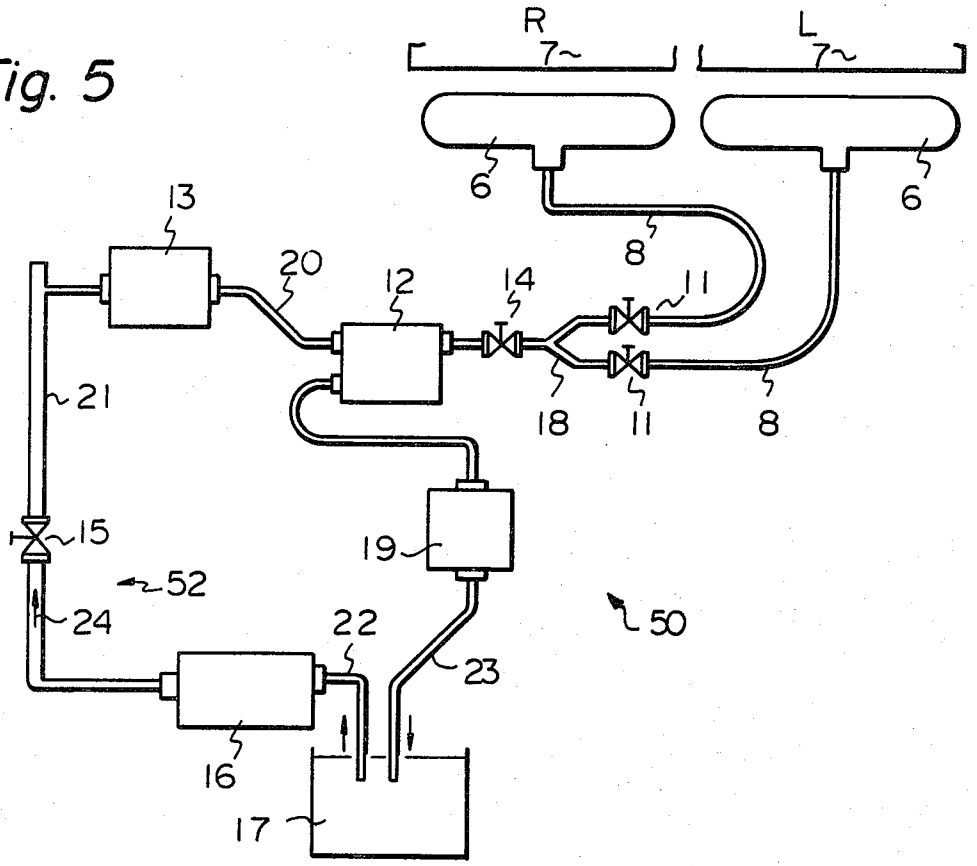
FIG. 5 illustrates a circuit of the liquid medium-supplying system.

Referring to FIG. 5, an embodiment of the fluid-medium supplying system 50 is illustrated. This means 50 comprises a fluid medium source 17, a conduit means 52 for defining a path between the fluid medium source 17 and the expansible tubes 6, and a conveying means for conveying the fluid in the conduit means 52, thereby generating an adjustable pressure in the expansible tubes 6. The conveying means comprises a pressure- or flowing amount- reduction valve 13 and a pump 16.

In this embodiment, a pair of expansible tubes 6 (L, R) located on either surface of one of the electrode holders 7 is connected to a common system for supplying the fluid medium. The fluid medium, the supply direction of which is denoted by the reference numeral 24, is stored in the fluid medium source 17, such as a tank. The conduits 8, 18, 20, 21, 22 and 23 form path between the fluid medium tank 17 and the expansible tubes 6. A pump 16 communicates with the fluid medium source 17 via a conduit 22 and transmits pressure to the fluid medium, thereby conveying the fluid medium via the valve 15 to the pressure- or flowing amount- reduction device 13, such as a reducing valve. The pressure of the fluid medium is reduced by the pressure- or flowing amount-reduction device 13 to a value at which the expansion of the expansible tubes 6 is realized, which expansion is necessary for adjusting the electrode distance to as small a value as possible but not causing a short circuit in the electrodes. The switching device 12, such as a valve, communicating with the pressure- or flowing amount- reduction device 13 via the conduit 20 is manually or automatically switched to communicate the conduits 8 with either the conduit 20, which supplies the fluid medium to the conduits 8, or the conduit 23, which removes the fluid medium to the fluid medium source 17. When the fluid medium is to be supplied to the expansible tubes 6, the fluid medium is conveyed via a valve 14 for controlling the flowing speed and the conduit 18 and is then distributed to a pair of conduits 8, i.e., the conduit for one side (R) of the expansible tubes 6 and the conduit for the other side (L) of the expansible tubes. It is possible, by means of a pair of valves 11, to control the expansion or shrinkage speed of each expansible tube 6 at speeds equal to or different from one another. The valves 11 may be omitted, when, for example, the expansion or shrinkage speed of each expansible tube 6 (L or R) is simultaneously varied by the valve 14 for controlling the flowing speed.

The removal of the fluid medium from the expansible tubes 6 to the fluid medium source 17, which causes their shrinkage, is carried out by closing a path through the conduits 20, 21 and 22. The pressure, which has been applied to the body of the expansible tubes 6, now causes the fluid medium to flow back via a relief valve 19 into the fluid medium source 17, while the body of expansible tubes is caused to shrink in accordance with a reduction in pressure or amount of the fluid medium. While the fluid medium is flowing back into the fluid medium source, the relief valve 19 maintains the fluid pressure at a predetermined level lower than the pressure determined by the pressure- or flowing amount-reduction device 13 but higher than the minimum value, at which the electrode holders 7 are held between the expansible tubes 6.

The fluid medium may be liquid, such as oil, or gas, such as air. When the fluid medium is air and it is not necessary to recover and reuse it, the fluid medium source 17 and its accompanying conduits 23 may be omitted.

Figure 6:
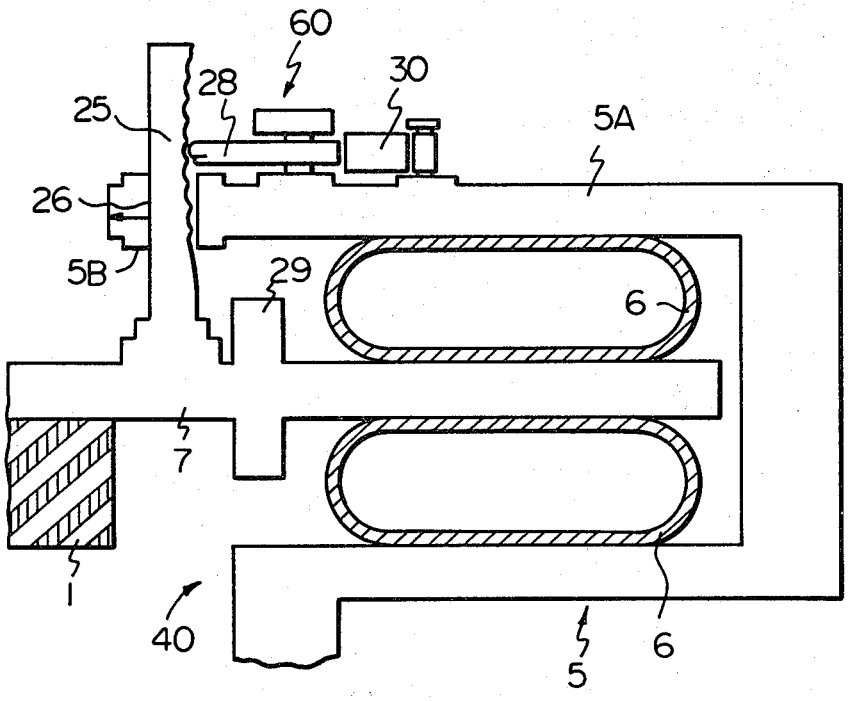
FIG. 6 is an enlarged view of the essential parts of the continuous electrolytic apparatus according to the present invention.

Referring to FIG. 6, a specific form of the tube holder 5 is illustrated. The tube holder 5 comprises a first section 5A, which defines a space for holding the expansible tube 6 between such section 5A and the electrode holder 7, and further comprises a second section 5B for positioning the respective electrode holder 7, with which the second section 5B engages. The electrode holder 7 comprises a guide rod 25 provided at both ends of the body thereof, which guide rod 25 protrudes through a slot 26 formed in the second section 5B of the tube holder 5, and the second section 5B comprises a means 60 for elastically engaging with the guide rod 25. The guide rod 25 is guided or displaced along the slot 26 while the expansible tubes 6 expand or shrink. The guide rod 25 is provided with notches in several places therof. The elastically engaging means 60 comprises a stopper 28 snugly fitted in one of the notches and a spring 30 for uninterruptedly applying pressure via the stopper 28 to the guide rod 25. The pressure mentioned above, symbolized by the arrow, ensures holding of the guide rod 25 in position when the pressure of the fluid medium does not appreciably vary. The elastically engaging means 60 is advisable for use in the continuous electrolytic processing apparatus with a compressible fluid medium. The displacement of the electrode holder 7 is restricted by spacers 29, separators and the like, which are fitted on the electrode holder 7 to prevent the expansible tubes 6 from collapsing.

Referring to FIGS. 7 through 10, other embodiments of the present invention, in which the electrode holders are horizontally disposed, are illustrated.

Figure 7:
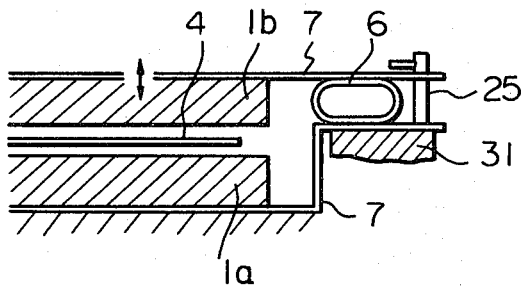
FIGS. 7 through 10 illustrate other embodiments of the present invention.
Figure 8:
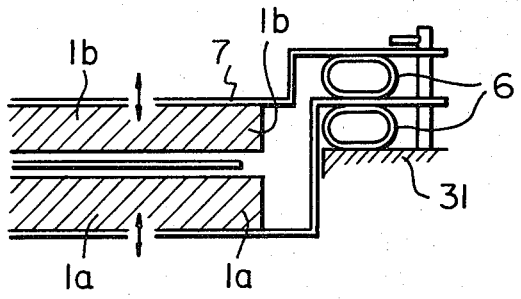

In FIGS. 7 and 8, the pressure of the expansible tubes 6 resisting the gravity of the electrode or electrodes 1 causes the electrode distance to vary. The lower electrode 1*a* in FIG. 7 is held stationarily or rigidly by the electrode holder 7, and a pair of expansible tubes 6 positioned on the base 31 allow the upper electrode 1*b* to be positioned at a variable electrode distance. Each of the lower and upper electrodes 1*a* and 1*b*, respectively, in FIG. 8 are positioned on a pair of respective expansible tubes 6 so that both the lowers and upper electrodes are dispalceable.

Figure 9:
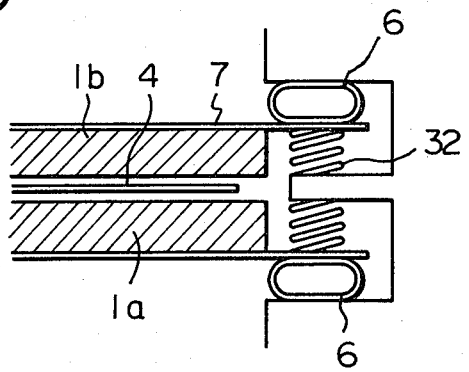
Figure 10:
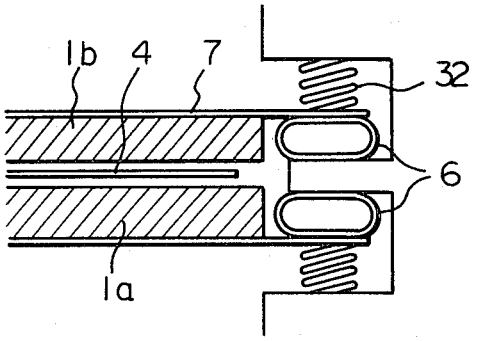

In FIGS. 9 and 10, the positioning means of the electrode holder 7 further comprises a spring means, such as coil springs 32, for holding the electrode holder 7 between the spring means and the expansible tube 6. The coil springs 32 and expansible tubes 6 cooperate with one another so that the electrode holders 7 are positioned to ensure a variable electrode distance. The embodiments shown in FIGS. 9 and 10 can be used for a vertical type continuous electrolytic processing apparatus.

The operating condition, which influences the efficiency of the electrolytic processing, can be usually detected by forming apertures through portions, e.g. the end portions of a metal strip and then detecting the apertures by an electrical or optical means. Such ends are usually irregularly shaped and necessitate a varitiation of the electrode distance.

From the descriptions hereinabove, it is quite evident that the present invention also includes other embodiments of a continuous electrolytic processing apparatus with the positioning means of the electrode ensuring a variable electrode distance due to the expansion or shrinkage of the expansible tubes during the electrolytic processing operation. The present invention is advantageous since the electrode distance can be adjusted optionally by controlling the pressure of the fluid medium admitted into the expansible tubes and further since the electrode distance can be adjusted to conform to a variation in the operation conditions of the electrolytic processing apparatus.

I claim:

1. A continuous electrolytic processing apparatus for a metal strip, comprising:

at least one electrode disposed to define an electrode distance between said electrode and said metal strip;

an electrode holder for each of said electrodes, the position of at least one of said electrode holders being adjustable in relation the other holder;

a means for positioning said electrode holder at an adjustable electrode distance and comprising at least one pair of expansible tubes elastically holding at least one of said electrode holders; and at least one system for supplying a fluid medium into said expansible tubes at an adjustable fluid pressure or amount.

2. A continuous electrolytic processing apparatus according to claim 1, wherein a pair of said electrodes is horizontally disposed to define a space therebetween, through which space said metal strip is conveyed.

3. A continuous electrolytic processing apparatus according to claim 2, wherein each of said electrode holders is held between four said expansible tubes at both ends thereof.

4. A continuous electrolytic processing apparatus according to claim 2, wherein the lower electrode holder is stationary and the upper electrode holder is held by a pair of said expansible tubes.

5. A continuous electrolytic processing apparatus according to claim 2, wherein each of the lower and upper electrode holders is held by a pair of expansible tubes.

6. A continuous electrolytic processing apparatus according to claim 2, wherein said positioning means further comprises a spring means for holding the electrode holder between said spring means and said expansible tube.

7. A continuous electrolytic processing apparatus according to claim 3, 4, 5 or 6, wherein said positioning means further comprises a tube holder for the expansible tubes.

8. A continuous electrolytic processing apparatus according to claim 3, 4, 5 or 6 further comprising a flexible current conductor electrically connected to each of said electrode holders.

9. A continuous electrolytic processing apparatus according to claim 3, 4, 5 or 6, wherein said pair of expansible tubes located on either surface of one of said electrode holders is connected to a common system for supplying said fluid medium.

10. A continuous electrolytic processing apparatus according to claim 9, wherein said system for supplying a liquid medium comprises:

a fluid medium source;

a conduit means for defining a path between said fluid medium source and said expansible tubes; and a conveying means for conveying said fluid medium in said conduit means.

11. A continuous electrolytic processing apparatus according to claim 7, wherein said tube holder comprises a first section, which defines a space for holding the expansible tube(s) between said first section and said electrode holder, and further comprises a second section for positioning said electrode holder, with which the second section engages.

12. A continuous electrolytic processing apparatus according to claim 11, wherein said electrode holders comprise a guide rod provided at both ends of the body thereof, which guide rod protrudes through a slot formed in said second section of said tube holder, and said second section comprises a means for elastically engaging with said guide rod.

* * * * *